US008635895B2

(12) United States Patent
Felkl

(10) Patent No.: US 8,635,895 B2
(45) Date of Patent: Jan. 28, 2014

(54) METHOD FOR COOLING A HOT STRIP WOUND TO A HOT STRIP BUNDLE, A DEVICE FOR COOLING A HOT STRIP, A CONTROL AND/OR A REGULATION DEVICE AND METAL STRIP

(75) Inventor: Hans-Joachim Felkl, Forchheim (DE)

(73) Assignee: Siemens Aktiengesellschaft, Munich (DE)

( * ) Notice: Subject to any disclaimer, the term of this patent is extended or adjusted under 35 U.S.C. 154(b) by 379 days.

(21) Appl. No.: 13/002,369

(22) PCT Filed: May 15, 2009

(86) PCT No.: PCT/EP2009/055929

§ 371 (c)(1), (2), (4) Date: Jan. 3, 2011

(87) PCT Pub. No.: WO2010/003723

PCT Pub. Date: Jan. 14, 2010

(65) Prior Publication Data

US 2011/0100080 A1 May 5, 2011

(30) Foreign Application Priority Data

Jul. 7, 2008 (EP) ..... 08012248

(51) Int. Cl.
*B21B 37/74* (2006.01)
*B21K 29/00* (2006.01)

(52) U.S. Cl.
USPC ..... 72/128; 72/11.3; 72/19.1; 72/202

(58) Field of Classification Search
USPC ..... 72/8.5, 11.3, 16.5, 18.3, 128, 200–202, 72/250, 146, 342.2, 342.94, 19.1
See application file for complete search history.

(56) References Cited

U.S. PATENT DOCUMENTS

| | | | | |
|---|---|---|---|---|
| 2,361,222 | A * | 10/1944 | McBride | 198/448 |
| 4,869,089 | A | 9/1989 | Kuramoto | 72/13 |
| 2006/0254682 | A1 | 11/2006 | Cornil et al. | 148/658 |

FOREIGN PATENT DOCUMENTS

| | | | | |
|---|---|---|---|---|
| DE | 2450548 | | 5/1976 | B21B 45/02 |
| DE | 102006038080 | | 2/2008 | G21B 45/02 |
| EP | 0992592 | A2 | 4/2000 | B21B 37/32 |
| GB | 1503189 | | 3/1978 | C21D 1/62 |
| JP | 59045018 | | 3/1984 | B21B 45/00 |
| JP | 2000326001 | A | 11/2000 | B21B 1/16 |
| RU | 2051976 | C1 | 1/1996 | C21D 1/02 |
| RU | 2061062 | C1 | 5/1996 | C21D 1/62 |
| RU | 2100449 | C1 | 12/1997 | C21D 1/02 |
| RU | 2287019 | C2 | 11/2006 | B21B 45/02 |

OTHER PUBLICATIONS

International PCT Search Report, PCT/EP2009/055929, 12 pages, Aug. 24, 2009.

* cited by examiner

*Primary Examiner* — Debra Sullivan
(74) *Attorney, Agent, or Firm* — King & Spalding L.L.P.

(57) ABSTRACT

In a method for cooling a hot strip wound to a hot strip bundle, a device for cooling a hot strip bundle, a control and/or regulating device, and a metal strip, the hot strip bundle (1) is twisted (100) and cooled by contact of the lateral surface (5) thereof with at least one element (3, 7). By twisting the hot strip bundle (1) about the axis of symmetry (S) thereof, a method and a device can be provided by which homogenous strip properties may be obtained for a cooling hot strip bundle in a compact manner.

17 Claims, 2 Drawing Sheets

METHOD FOR COOLING A HOT STRIP WOUND TO A HOT STRIP BUNDLE, A DEVICE FOR COOLING A HOT STRIP, A CONTROL AND/OR A REGULATION DEVICE AND METAL STRIP

CROSS-REFERENCE TO RELATED APPLICATIONS

This application is a U.S. National Stage Application of International Application No. PCT/EP2009/055929 filed May 15, 2009, which designates the United States of America, and claims priority to EP Application No. 08012248.4 filed Jul. 7, 2008. The contents of which are hereby incorporated by reference in their entirety.

TECHNICAL FIELD

The invention relates to a process for cooling a hot strip, which is coiled up to form a hot strip coil, by means of an intermediate bearing device which differs from a coiler. Furthermore, the invention relates to an apparatus for cooling a hot strip coil and also to a control and/or regulation device for an apparatus for cooling a hot strip coil. Finally, the invention relates to a metal strip.

BACKGROUND

During the production of hot strip by means of a hot rolling train, the hot strip is generally coiled up on a coiler to form a hot strip coil at the end of the hot rolling train. In this case, the hot strip has generally already passed through a cooling section, in which the desired microstructure of the hot strip and therefore the properties thereof have been set. Examples of metals which undergo such processes are steel, aluminum and copper. However, other strips of different metals are also processed in hot rolling trains.

Particularly in the case of microstructures of modern metal qualities, in particular of steel, aluminum and copper, it may be found that the metallurgical properties thereof also change even after the actual hot rolling. By way of example, the cooling of the hot strip coil may be accompanied by instances of local hardening of the hot strip coil on the coil store which, in a subsequent cold rolling process for said hot strip coil, can result in barely controllable disruption to the strip quality of said metal strip. In particular, such disruptions occur cyclically with a variable period duration as a result of the unwinding of the hot strip coil, caused by the coil circumference changing during unwinding. As a result of such cyclic hardness fluctuations, it is possible, for example in multi-stand cold rolling mills, in particular tandem rolling mills, for self-energizing vibrations to arise, which have a negative influence on the strip quality of the metal strip to be produced.

In order to avoid this problem of self-energizing vibrations in the case of multi-stand cold rolling trains, provision can be made, by way of example, for metal strips of such sensitive metal qualities to be rolled on a single-stand cold rolling mill.

However, this results in an increased rolling time for each metal strip, in order to achieve the final dimensions of the respective metal strip, and is therefore disadvantageous from an economical point of view compared to rolling of the metal strip in a multi-stand cold rolling train.

Laid-open specification DT 24 50 548 A1 discloses a cooling apparatus for rolled stock, in particular strip coils, which are cooled with the aid of gondolas which occasionally move through a trough of cooling liquid. This solution takes up a large amount of space and is unsuitable for the requirements of modern metal qualities.

U.S. Pat. No. 4,869,089 discloses an apparatus which prevents the discharge of heat from the hot strip coil by virtue—if a predefined temperature difference between an outer and an inner layer of the hot strip coil is exceeded—of a thermally insulating cover, so that the cooling rate of the outermost layer of the hot strip coil is reduced. This document therefore deals with relatively large-area—with respect to the strip length—temperature disruptions when cooling hot strip coils during the intermediate mounting thereof.

SUMMARY

According to various embodiments, a process and an apparatus can be provided, by means of which homogeneous strip properties of the hot strip coil can be obtained in a compact manner, in particular in the circumferential direction, for outer surface regions which are small compared to the outer surface of the hot strip coil, and also the metal strip itself cooled in this way.

According to an embodiment, in a process for cooling a hot strip, which is coiled up to form a hot strip coil, by means of an intermediate bearing device which differs from a coiler, during the intermediate mounting, the hot strip coil is mounted at least in certain portions on the outer surface thereof, is rotated about the axis of symmetry thereof and is cooled by virtue of the fact that the outer surface thereof makes contact with at least one physical element.

According to a further embodiment, the physical element for cooling may be simultaneously used as a bearing element for mounting the hot strip coil. According to a further embodiment, a mean outer surface temperature of the hot strip coil can be determined, a temperature for a segment of the outer surface can be detected, and, as a function of a difference between the temperature of the outer surface segment and the mean outer surface temperature, a contact time between the outer surface segment and the at least one element can be set in such a manner that the difference is reduced. According to a further embodiment, a mean contact time between an outer surface segment and the at least one element can be set by a predefinable rotational speed of the hot strip coil, wherein, in the event of a positive or negative temperature difference, the contact time is increased or lowered in relation to the mean contact time. According to a further embodiment, the temperature of the outer surface segment can be detected in a contactless manner. According to a further embodiment, the mean outer surface temperature can be determined from a multiplicity of temperatures detected for various outer surface segments. According to a further embodiment, cooling of an outer surface segment by the at least one physical element may be precalculated with the aid of a model, and the contact time is set on the basis of the calculation. According to a further embodiment, a cooling power of the at least one physical element can be set.

According to another embodiment, an apparatus for cooling a hot strip coil, may have at least one physical element which cools a segment of an outer surface of the hot strip coil, having a bearing element for mounting the hot strip coil on the outer surface thereof, having a drive device for rotating the hot strip coil about the axis of symmetry thereof, and having a control device as described below, by means of which the drive device is operatively connected.

According to a further embodiment of the apparatus, the at least one physical element may be configured as a bearing element. According to a further embodiment of the apparatus, the apparatus may comprise a device for detecting a temperature of the at least one outer surface segment, wherein the control device is additionally operatively connected to the temperature detection device. According to a further embodiment of the apparatus, the drive device may comprise the at least one element. According to a further embodiment of the apparatus, the apparatus may comprise a cooling device for the settable cooling of the at least one physical element.

According to yet another embodiment, a control and/or regulation device for an apparatus for cooling a hot strip coil, may comprise a machine-readable program code having control commands which, when said program code is executed, prompt the control device to carry out the process as described above.

According to yet another embodiment, a metal strip may be cooled by a process as described above, wherein the cooling takes place in such a manner that the standard difference between the hardness distribution in the circumferential direction of the hot strip coil and the mean value of the hardness distribution is less than 20%.

BRIEF DESCRIPTION OF THE DRAWINGS

Further advantages of the invention will emerge from the following exemplary embodiment, which is explained in more detail with reference to schematic drawings.

DETAILED DESCRIPTION

Figure 1:
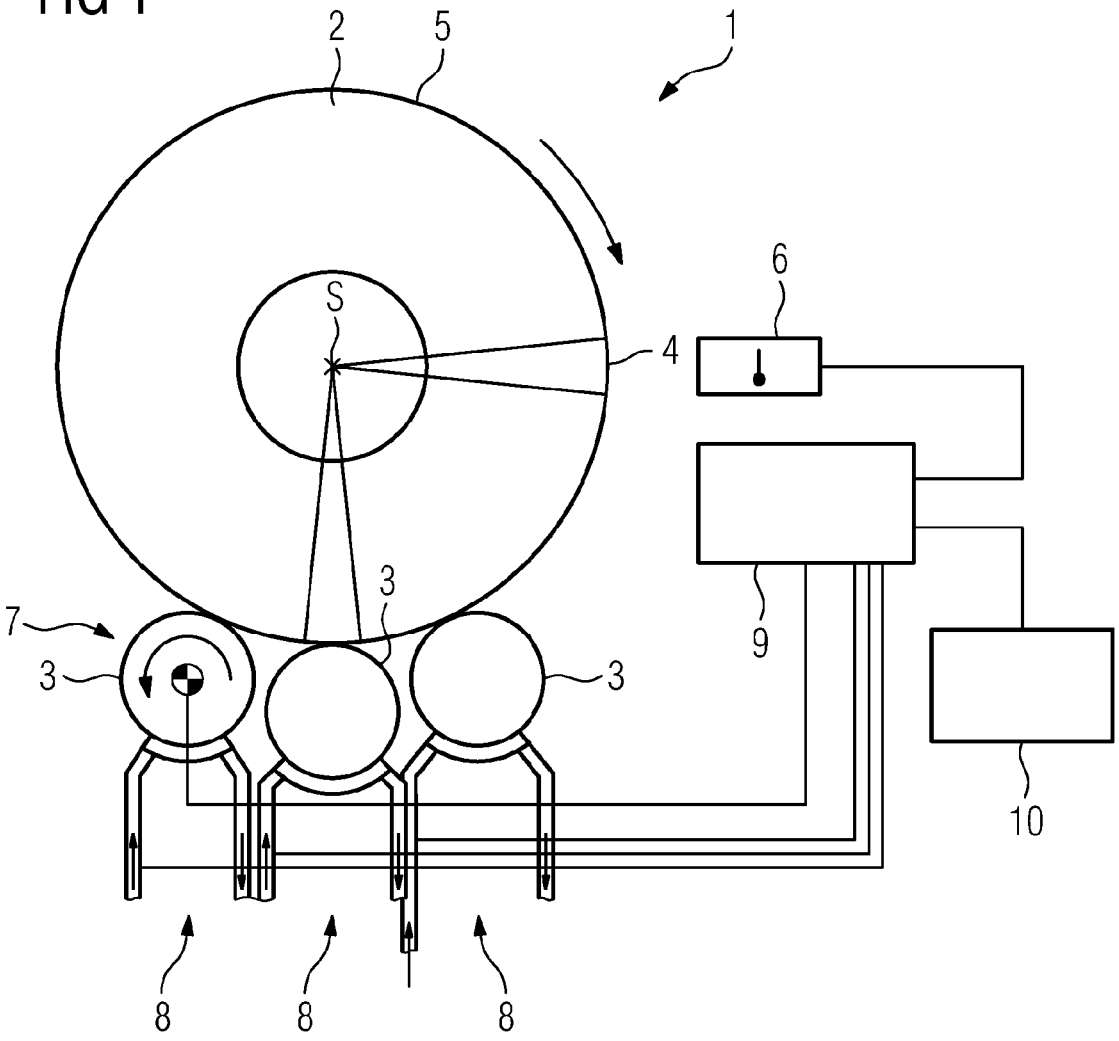
FIG. 1 is a schematic view showing an apparatus for cooling a hot strip coil suitable for carrying out the process according to various embodiments.

According to an embodiment, in a process for cooling a hot strip, which is coiled up to form a hot strip coil, by means of an intermediate bearing device which differs from a coiler, during the intermediate mounting, the hot strip coil is rotated about the axis of symmetry thereof, is mounted at least in certain portions on the outer surface thereof and is cooled by virtue of the fact that the outer surface thereof makes contact with at least one physical element. The outer surface is regarded as the radially outwardly facing boundary surface of the hot strip coil which is formed by the width of the coiled-up hot strip of the outermost winding. The axis of symmetry of the hot strip coil runs substantially through the center point of the hot strip coil perpendicularly to the radial extent of the hot strip coil. A particularly compact, feasible procedure is provided by rotation about said axis of symmetry in order to provide homogeneous strip properties after the cooling. The physical element has a fixed, delimited form with respect to the area surrounding it, where it is possible to realize a very wide variety of elasticities. By way of example, the physical element may be in the form of a rigid body, where the outer surface is covered at least in certain portions with an elastic material in order to mount the hot strip coil carefully and avoid damage to the surface. In addition, the thermal properties of the material can be set so as to be appropriate for the desired cooling rate. It is thereby possible to set the thermomechanical properties of the physical element appropriately. In particular, a physical element of this type can be formed in such a manner that it causes the hot strip coil to rotate about the axis of symmetry thereof. Since a physical element is used for the uniform cooling of the hot strip coil, a technically particularly simple solution which takes up little space is provided. A physical element is preferably formed in such a manner that it makes contact with the outer surface of the hot strip coil substantially over the entire outer surface height. By way of example, the intermediate bearing device may be in the form of a supply store device for hot strip coils or of a conveying device for hot strip coils. By means of such a conveying device, in particular, it is possible firstly for the hot strip coils to be moved to specific positions within a rolling installation, and secondly these are cooled uniformly over the circumference by the process according to various embodiments as they are conveyed, as a result of which the hot strip coil has a uniformly high structural quality.

In an embodiment, the physical element is simultaneously used as a bearing element for mounting the hot strip coil. By way of example, the physical element can be in the form of a movable bearing roller, on which the hot strip coil is rotated about the axis of symmetry thereof. Furthermore, in this case the physical element is formed in such a manner that it can at least partially absorb the weight of the hot strip coil.

Within the context of this application, the term "mounting" is generally to be understood as meaning that the mounting always requires a force of the weight of the hot strip coil to be absorbed by the bearing element as well. Bending rollers for a hot strip coil mounted on a coiler drum are not bearing elements, for example, since these generally do not absorb any force of the weight of the hot strip coil, but instead merely apply bending forces for shaping the hot strip coil.

According to an embodiment, a mean outer surface temperature of the hot strip coil is determined, a temperature for a segment of the outer surface is detected, and, as a function of a difference between the temperature of the outer surface segment and the mean outer surface temperature, a contact time between the outer surface segment and the at least one element is set in such a manner that the difference is reduced. This has the effect that local temperature fluctuations of the outer surface of the hot strip coil can be cooled to a greater or lesser extent in a targeted manner, in order to obtain a temperature which is as identical as possible for all segments of the outer surface. At any time, it is understandable and verifiable which segments of the outer surface differ particularly greatly from a mean outer surface temperature and therefore require a particularly high or low level of cooling. In this respect, it is possible to establish emission of heat from the respective outer surface segment to the physical element by setting the contact time between the respective outer surface segment and the at least one physical element. This increases the accuracy for achieving homogeneous strip properties or coil properties.

It is advantageous, in particular, for a mean contact time between an outer surface segment and the at least one element to be set by a predefinable rotational speed of the hot strip coil, wherein, in the event of a positive or negative temperature difference, the contact time is increased or lowered in relation to the mean contact time. This procedure makes it possible to provide a slight difference between temperatures of the outer surface segments and the mean outer surface temperature in a particularly simple manner. In other words, this means that the rotational speed of the hot strip coil is dependent on the temperature of that segment of the outer surface which is presently making contact with the element, in particular the physical element.

According to an embodiment, the temperature of the outer surface segment is detected in a contactless manner. This firstly has the effect that no falsifications arise as a result of contact-related temperature measurement, which, as a result of the contact, would lead to the discharge of heat from the hot strip coil to the temperature detection device. Secondly, there are a multiplicity of known and metrologically accurate apparatuses for contactless temperature detection with which the temperature of an outer surface segment can be detected. By way of example, pyrometers and/or ondometers may be used.

According to an embodiment, the mean outer surface temperature is determined from a multiplicity of temperatures detected for various outer surface segments.

The mean outer surface temperature is therefore always traced back to measured values of the multiplicity of temperatures detected for various outer surface segments. The mean temperature of the outer surface is preferably formed from the temperatures of the outer surface segments detected within the last revolution of the hot strip coil. The last measured value of a specific outer surface segment is therefore always replaced by the new measured value for said outer surface segment in order to determine the mean outer surface temperature, as a result of which the mean outer surface temperature is appropriately matched to the continuous cooling of the hot strip coil. The use of a multiplicity of outer surface segments firstly increases the accuracy for the uniformity of the cooling of the hot strip coil, and simultaneously improves the determination of the mean outer surface temperature.

According to an embodiment, cooling of an outer surface segment by the at least one element is precalculated with the aid of a model, and the contact time is set on the basis of the calculation. This is advantageous, in particular, when a multiplicity of physical elements which have a cooling action and simultaneously make contact with different outer surface segments of the hot strip coil are provided. Such a model is based on the thermal conduction equation and may also include phase transitions which are still possible for the metal to be cooled. Thermal radiation and thermal convection for the hot strip coil can also be included. The use of a cooling model for cooling the hot strip coil makes it possible to obtain particularly accurate and purposeful cooling of the hot strip coil. In particular, the cooling process can be changed in such a manner that, for example, the sum of the differences between the temperatures of the outer surface segments and the mean outer surface temperature is minimal for a predefinable temperature to be reached. The rotation of the hot strip coil is then controlled by the presettings of the model in such a manner that the desired result is achieved. In particular, the use of a model can have the effect that the coiled-up hot strip or the hot strip coil has homogeneous microstructure properties and, by way of example, undesirable strip properties or hot strip coil properties of the hot strip coil can still be avoided or eliminated during the cooling by inclusion of the changes to strip properties or hot strip coil properties which are brought about by the cooling process. By using a model for the cooling process, it is possible, if appropriate, to also influence the microstructure in such a manner that it is optimized for subsequent cold rolling. In this respect, this can affect not only fluctuations in hardness of the metal strip, but also the hardness of the metal strip as such. By way of example, a strip which is optimized for the demands of cold rolling can be provided, in particular, by the determination of a suitable cooling rate within the possible tolerances.

According to an embodiment, a cooling power of the at least one element is set, preferably controlled and/or regulated. This makes it possible, for example, for a physical element to be supplied with a cooling medium with which it is additionally possible to influence the discharge of heat from the outer surface segment which is respectively in contact with the element. In the case of a liquid or gaseous element, continuous mass transfer can take place, for example, in order to ensure that there is an appropriate cooling power and, for example, to avoid heating of the element to an undesirable temperature. The setting of the cooling power is expedient, for example, when temperatures of individual outer surface segments differ particularly greatly from the mean outer surface temperature. If such differences were to occur purely as a result of the contact time with the cooling element, without the cooling power being influenced, this would result in a significant increase in the cooling duration for the entire hot strip coil, for example. In order to keep the cooling time of the entire hot strip coil low even under such conditions, a cooling power of the at least one element can then be increased, for example, in order to adapt the temperature of said outer surface segment to the mean outer surface segment temperature as quickly as possible. If appropriate, it is also possible to desirably influence the microstructure of the hot strip coil by virtue of the targeted control or regulation of the cooling power of the at least one element. In particular, the cooling rate of the hot strip coil is predefinable when controlling or regulating the cooling power of the at least one element. By way of example, this means that hot strip coil is cooled quickly but nevertheless uniformly, if appropriate for filling in process gaps in the cold rolling train, in order to optimally utilize a cold rolling train, for example.

According to further embodiment, an apparatus can be achieved by a control and/or regulation device for an apparatus for cooling a hot strip coil, comprising machine-readable program code having control commands which, when the program code is executed, prompt the control and/or regulation device to carry out a process as described above. The use of a control and/or regulation device to carry out the above-described process makes it possible to achieve particularly high accuracy when cooling the hot strip coil, which is reflected in improved rolling properties of the hot strip coil in the cold rolling train.

According to further embodiments, an apparatus for cooling a hot strip coil, may have at least one physical element which cools a segment of an outer surface of the hot strip coil, having a bearing element for mounting the hot strip coil on the outer surface thereof, having a drive device for rotating the hot strip coil about the axis of symmetry thereof, and having a control device as described above, by means of which the drive device is operatively connected. Such an apparatus provides a particularly simple and accurate way of cooling hot strip coils, in particular hot strip coils which are sensitive to cooling.

According to an embodiment, the at least one physical element is configured as a bearing element. The compactness of the apparatus can thereby be increased further. The physical element is thereby multifunctional. It brings about mounting of the hot strip coil and cooling in a component.

The apparatus preferably also comprises a device for detecting a temperature of the at least one outer surface segment, wherein the control device is additionally operatively connected to the temperature detection device. It is thereby possible to implement a closed control system. The quality of the hot strip coil is further increased as a result.

According to an embodiment, the drive device comprises the at least one, in particular physical, element. In particular, the drive device comprises a drive roller which is in contact at least in certain portions with the outer surface of the hot strip coil and causes the hot strip coil to rotate. This makes it possible for the apparatus to have a particularly compact configuration. The physical element therefore has a bearing function, a drive function and a cooling function.

According to an embodiment, a cooling power of the at least one physical element can be set, in particular controlled and/or regulated. It is thereby possible to influence an additional parameter range for cooling the hot strip coil, with which the cooling of the hot strip coil can be controlled.

Furthermore, the temperature of outer surface segments of the hot strip coil can be influenced in a rapid and purposeful manner owing to the fact that the cooling power of the at least one element can be controlled or regulated.

According to further embodiments, a metal strip can be cooled by a process as described above and which thereby has a standard difference between the hardness in the circumferential direction and the mean value of less than 20%. In order to determine the hardness, the processes known for hardness determination can be used, for example the Vickers hardness determination.

FIG. 1 shows a hot strip coil 1, consisting of coiled-up hot strip 2. The hot strip coil 1 has an axis of symmetry S. This runs perpendicularly to the plane of the drawing through the center of the hot strip coil 1.

The hot strip coil 1 is mounted on three movable rollers. In FIG. 1, one of these rollers is in the form of a drive roller 7. The other two rollers are in the form of passive, rotatably mounted bearing rollers 3. Both the drive roller 7 and the other two bearing rollers 3 are physical elements, which make contact with part of the outer surface 5 of the hot strip coil 1. The drive roller 7 can rotate the hot strip coil 1 about the axis of symmetry S thereof. In the exemplary embodiment, the rollers 3 and 7 are configured in such a manner that the outer surface height thereof is at least as great as the outer surface height of the hot strip coil 1, i.e. the rollers make contact with the outer surface 5 of the hot strip coil 1 over the entire outer surface height.

If the hot strip coil 1 is at a temperature which is significantly higher than room temperature, the hot strip coil outputs heat at the contact points of the bearing rollers 3 or of the drive roller 7 both by thermal radiation and by thermal conduction.

In order to avoid nonuniform cooling at the regions in which the hot strip coil 1 makes contact with the bearing rollers 3 or the drive roller 7, the hot strip coil is made to rotate about the axis of symmetry S thereof. This has the effect that each point of the outer surface 5 of the hot strip coil 1 temporarily comes into contact with the bearing rollers 3 or the drive roller 7. The outer surface 5 of the hot strip coil 1 is thereby uniformly cooled.

To further improve the uniform cooling of the hot strip coil 1, a temperature detection device 6 for detecting the temperature of the outer surface 5 of the hot strip coil 1 is provided.

In FIG. 1, a temperature detection device 6 is provided for detecting the temperature of the outer surface 5 in a contactless manner. In particular, the temperature detection device 6 detects the temperature of segments 4 of the outer surface 5 of the hot strip coil 1. In the exemplary embodiment, the outer surface segments are rectangular cylinder segments, i.e. the boundary lines of the segments extending in the outer surface intersect the base surface of the cylinder at right angles. In practice, this is particularly easy to manage.

The detected temperature of an outer surface segment 4 is supplied to a control device 9. Furthermore, a mean outer surface temperature is calculated from the temperatures of the outer surface segments 4, in particular for those which have been detected within a winding of the hot strip coil 1.

The control device 9 then compares the detected temperature of each outer surface segment 4 with the mean temperature of the outer surface 5. The drive roller 7 is controlled depending on the difference between the detected temperature of the outer surface segment 4 and the mean outer surface temperature.

The control device 9 controls the drive roller 7 in such a manner that the change to the rotational speed of the hot strip coil 1, which is predefined by the control device, is only applied to the drive roller 7 when the outer surface segment 4, of which the temperature has been detected and where corresponding control signals have been determined therefrom for the drive device 7, comes into contact with the first physical element in the rotational direction, i.e. with a bearing roller 3 in FIG. 1.

If the temperature of the outer surface segment 4 is higher than the mean outer surface temperature, the rotational speed is reduced when the outer surface segment 4 makes contact with the first bearing roller 3, so that the contact time and thus the time for the transfer of heat between the hot strip coil and the bearing roller 3 or drive roller 7 is increased.

If the temperature of the outer surface segment 4 is lower than the mean outer surface temperature, the rotational speed is accordingly increased when said outer surface segment 4 makes contact with the first bearing roller 3 or the second bearing roller 3 or the drive roller 7, so that the contact time and thus the time for heat exchange between the bearing rollers 3 or drive roller 7 and the outer surface segment 4 is accordingly kept low.

In addition, the control device 9 can access a model 10, in which the thermal conduction equation is used to precalculate how the temperature of the outer surface 5 of the hot strip coil 1 changes locally. In this case, the intervals at which the outer surface segments 4 have specific temperature differences are taken into account in particular, and a precalculation is made preferably over a plurality of revolutions of the hot strip coil 1 as to how the temperature of the outer surface segments behaves with a specific control method and influences the cooling of the hot strip coil in such a manner that, as far as possible, homogeneous properties of the coiled-up hot strip 2 are ensured after the cooling.

Depending on the precalculation by the model 10, the control device 9 is supplied with information, on the basis of which the control device 9 sets the control signals of the drive roller 7.

In particular, the model module 10 can be used to determine an average rotational speed of the hot strip coil 1, which leads to optimized rolling behavior in the subsequent cold rolling process.

In FIG. 1, the bearing rollers 3 and the drive roller 7 additionally each have a cooling device 8. Said cooling device, in particular the cooling power thereof, is likewise controlled by the control device 9. By way of example, cooling media or Peltier elements can be used.

The surfaces of the drive roller 7 or of the bearing rollers 3 can be thermally conditioned by the cooling device 8. This means that it is possible to set constant surface temperatures of the rollers 3 and 7, for example. As an alternative, the surfaces of the drive roller 7 or of the bearing rollers 3 may be cooled down greatly, for example, in order to establish a large, desirable temperature gradient between the outer surface 5 of the hot strip coil 1 and the surfaces of the bearing rollers 3 or of the drive roller 7. This accelerates the cooling of the hot strip coil. However, it must be taken into consideration that the temperature differences between the outer surface segments of the outer surface of the hot strip coil 1 must not become so large that inhomogeneities which are no longer remediable arise in the hot strip 2. The maximum usable temperature gradient between an outer surface segment 4 of the hot strip coil 1 and one of the rollers 3 or 7 is dependent, inter alia, on the mean rotational speed, on the material of the hot strip 2 of the hot strip coil 1 and on the outer surface temperature of the hot strip coil 1.

The apparatus shown in FIG. 1 has the effect that a hot strip coil 1 is cooled uniformly, with a predefinable expenditure of time, in such a manner that the hot strip coil has homogeneous strip properties, in particular a homogeneous hardness, and problems can be avoided or reduced during rolling of the strip for a subsequent cold rolling process.

Figure 2:
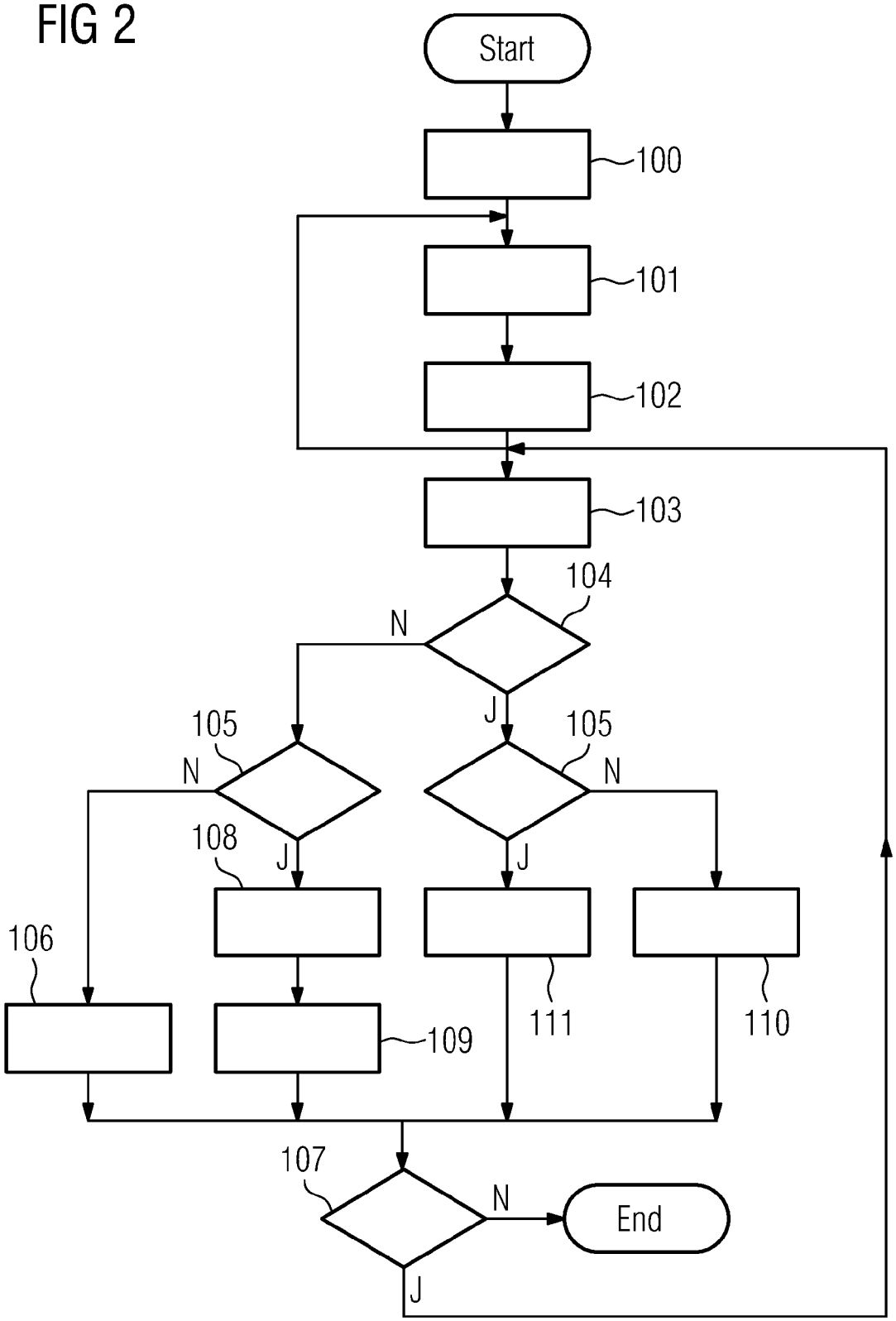
FIG. 2 shows a flow diagram in order to schematically show the sequence of the process according to various embodiments.

FIG. 2 shows a flow diagram for an exemplary sequence of the process according to various embodiments. In a process step 100, the hot strip coil is made to rotate about the axis of symmetry thereof.

In a process step 101, the temperature of outer surface segments is measured continuously, and a mean outer surface temperature is determined from said measurements in a process step 102, after the end of the first rotation which has been detected completely by temperature metrology after the start of measurement. The outer surface temperature is determined successively on the basis of the new temperature values for the continuously detected temperature of the outer surface segments.

Furthermore, in a process step 103, the detected temperature of an outer surface segment is used to make a comparison with the mean outer surface temperature. In this case, a positive or negative deviation from the mean outer surface temperature is generally established.

In a process step 104, it is then asked whether it is necessary to calculate a precalculation of the cooling operation of the hot strip coil with the aid of a cooling model. The quality of the cooling operation can thereby be improved further.

If this is not desired, it is checked in a process step 105 whether it is necessary to control the cooling power of the elements, for example physical elements, which cool the hot strip coil and make contact with the hot strip coil in certain portions. This query is only expedient when the cooling power of the elements is settable.

The cooling power of the elements which have a settable cooling power can be set in a targeted manner, for example, when the hot strip coil is intended to be available within a defined, short time for cold rolling.

If targeted setting of the cooling power is not desired, in a process step 106 a control intervention is made in the drive device for rotating the hot strip coil on the basis of the detected temperature of the outer surface segment and the mean outer surface temperature. Said control intervention is configured in such a manner that it leads to a reduction in the difference between the temperature of the outer surface segment and the mean outer surface temperature.

In particular, in this case the drive device is controlled by the control device in such a manner that the control intervention, i.e. the increase or reduction of the contact time in relation to the mean contact time between the outer surface segment and the physical element, only becomes effective when the respective outer surface segment with the associated detected temperature comes into contact with a physical element.

If the temperature of the detected outer surface segment is higher than the mean outer surface temperature, the contact time between said outer surface segment and the physical element is increased. If the detected temperature of the outer surface segment is lower than the mean outer surface temperature, the contact time between said respective outer surface segment and the physical element is also reduced, i.e. the rotational speed is increased, until said outer surface segment is no longer in contact with the physical element.

In the event that no precalculation of the cooling to be controlled is desired in a process step 104, the control of a cooling power of a physical element can also be approved in a process step 105. In a process step 108, the desired cooling power is then calculated and set. The setting of the cooling power is preferably controlled or regulated on the basis of the detected temperatures of the outer surface segments and/or of the mean outer surface temperature. In a process step 109, a control intervention is then made for the drive device on the basis of the calculated and set cooling power, said control intervention taking the changed cooling power of the physical elements which make contact with the outer surface of the hot strip coil at least in certain portions into consideration. The setting of the cooling power can be used, in particular, when the homogeneous cooling no longer appears to be possible without a settable cooling power owing, for example, to a technical defect.

If a decision is made in process step 104 that the cooling process is to be precalculated, it should also be chosen here, in a process step 105, whether the cooling power of the, in particular physical, element is to be controlled or not. The cooling process is then precalculated depending on whether a specific cooling power of the element is to be set or not.

If a cooling power of the at least one physical element is to be set with the aid of a cooling device, a control intervention is made in accordance with process step 111 for the drive device and the cooling device, to the effect that firstly differences in temperature between the outer surface segments and the mean outer surface temperature are minimized as far as possible, and that the properties of the hot strip coil are optimized for a subsequent cold rolling process, in that—if possible—the microstructure of the hot strip coil is still influenced. Furthermore, the control intervention can be provided depending on a cooling duration after which the hot strip coil has to be fed into the cold rolling train, so that optimum use is made of the cold rolling train. Accordingly, the cooling power of the at least one element is then also adapted.

In the event that the cooling power of the physical elements is not to be controlled in process step 105, and therefore the duration of the cooling operation does not play a significant role, for example, the control intervention in accordance with process step 110 for the drive device can be made, for example, in such a manner that the difference between the outer surface segment temperatures and the mean outer surface temperature is as small as possible, and simultaneously the properties of the hot strip are still influenced in such a manner that it is manageable to the best possible extent for the subsequent cold rolling process. A cooling rate can then be set, for example, via the rotational speed of the hot strip coil.

If a control intervention is made, it is asked, in a process step 107, whether the process should be continued. If this is the case, an outer surface segment is newly compared with the newly determined mean outer surface temperature. If the process is not to be continued, the process ends after the last control intervention.

Such a process can provide controlled, uniform cooling of a hot strip coil which is optimized in terms of a homogeneous hardness, a hardness optimized with regard to the cold rolling and, if appropriate, in terms of a cooling duration.

What is claimed is:

1. A process for cooling a hot strip, which is coiled up to form a hot strip coil, using a bearing device which differs from a coiler, the process comprising:

mounting the hot strip coil on the bearing device such that at least portions of an outer surface of the hot strip coil are in contact with at least one physical element of the bearing device, rotating the hot strip coil about a rotational axis, cooling the hot strip coil via heat transfer between the outer surface of the hot strip coil and the at least one physical element of the bearing device, determining a temperature of the hot strip coil using a temperature detection device, and controlling a rotation of the hot strip coil based on the determined temperature of the hot strip coil.

2. The process according to claim 1, wherein the at least one physical element comprises at least one bearing element for mounting the hot strip coil.

3. The process according to claim 1, comprising:

determining a mean outer surface temperature of the hot strip coil, determining a temperature for a segment of the outer surface of the hot strip coil, determining a contact time between the outer surface segment and the at least one physical element of the bearing device as a function of a difference between the temperature of the outer surface segment and the mean outer surface temperature, and controlling the rotation of the hot strip coil to provide the determined contact time between the outer surface segment and the at least one physical element of the bearing device.

4. The process according to claim 3, comprising:

setting a mean contact time between the outer surface segment of the hot strip coil and the at least one physical element of the bearing device by a predefinable rotational speed of the hot strip coil, and increasing or decreasing the contact time in response to determining a positive or negative temperature difference.

5. The process according to claim 3, wherein the temperature of the outer surface segment is detected in a contactless manner.

6. The process according to claim 3, wherein the mean outer surface temperature is determined from a multiplicity of temperatures detected for various outer surface segments.

7. The process according to claim 3, comprising calculating a cooling of the outer surface segment by the at least one physical element using a model, and setting the contact time based on the calculation.

8. The process according to claim 1, comprising setting a cooling power of the at least one physical element.

9. An apparatus for cooling a hot strip coil, comprising:

at least one physical element for mounting the hot strip coil such that an outer surface of the hot strip coil is in contact with at least one physical element, a drive device for rotating the hot strip coil about a rotational axis, a temperature detection device configured to detect a temperature of at least one outer surface segment of the outer surface of the hot strip coil, and a control device operably coupled to the temperature detection device and the drive device, wherein the control device comprises a processor and program code stored in non-transitory computer-readable media and executable by the processor to:

receive temperature data from the temperature detection device regarding the at least one outer surface segment of the hot strip, control the drive device to rotate the hot strip coil about the rotational axis based on the received temperature data.

10. The apparatus according to claim 9, wherein the at least one physical element comprises at least one bearing element.

11. The apparatus according to claim 9, wherein the at least one physical element comprises the drive device.

12. The apparatus according to claim 9, comprising a cooling device for cooling the at least one physical element.

13. A control device for an apparatus for cooling a hot strip coil, the control device operably coupled to a temperature detection device configured to detect temperature data regarding the hot strip coil and to a drive device configured to rotate the hot strip coil about a rotational axis, the control device comprising:

a processor, and program code stored in non-transitory computer-readable media and executable by the processor to:

receive temperature data from the temperature detection device, based on the received temperature data:

determine a mean outer surface temperature of the hot strip coil, and determine a temperature of a segment of the outer surface of the hot strip coil, determine a difference between the temperature of the outer surface segment and the mean outer surface temperature, determine a contact time between the outer surface segment and the at least one physical element as the function of the difference between the temperature of the outer surface segment and the mean outer surface temperature, and control the drive device to rotate of the hot strip coil to provide the determined contact time between the outer surface segment and the at least one physical element.

14. The control device according to claim 13, wherein the at least one physical element comprises at least one bearing element for mounting the hot strip coil.

15. The control device according to claim 13, wherein the control device is further configured to:

set a mean contact time between the outer surface segment of the hot strip coil and the at least one physical element by a predefinable rotational speed of the hot strip coil, and increase or decrease the contact time in response to determining a positive or negative temperature difference.

16. The control device according to claim 13, wherein the temperature of the outer surface segment is detected in a contactless manner.

17. The control device according to claim 13, wherein the mean outer surface temperature is determined from a multiplicity of temperatures detected for various outer surface segments.

* * * * *